US005191261A

United States Patent [19]

Mass

[11] Patent Number: 5,191,261

[45] Date of Patent: Mar. 2, 1993

[54] SWITCHING POWER SUPPLY FOR HIGH-VOLTAGE FLASH LAMPS

[75] Inventor: Barton Mass, San Jose, Calif.

[73] Assignee: Purus, Inc., San Jose, Calif.

[21] Appl. No.: 714,385

[22] Filed: Jun. 11, 1991

[51] Int. Cl.[5] ..... H05B 37/00

[52] U.S. Cl. ..... 315/171; 315/172; 315/173; 315/176; 315/240; 315/241 R; 315/246; 315/362

[58] Field of Search ..... 315/171, 172, 173, 175, 315/176, 240, 241 R, 246, 250, 362; 372/38

[56] References Cited

U.S. PATENT DOCUMENTS

| | | | |
|---|---|---|---|
| 3,323,015 | 5/1967 | Everest | 315/176 |
| 3,551,738 | 12/1970 | Young | 315/171 |
| 3,577,174 | 5/1971 | Longsderff | 315/173 |
| 3,914,648 | 10/1975 | Friedman et al. | 315/171 |
| 3,967,212 | 6/1976 | Dere et al. | 372/35 |
| 4,005,333 | 1/1977 | Nichols | 372/72 |
| 4,012,321 | 3/1977 | Koubek | 210/63 R |
| 4,131,939 | 12/1978 | Day | 363/126 |
| 4,245,294 | 1/1981 | Brolin | 363/126 |
| 4,246,513 | 1/1981 | Pettit et al. | 315/176 |
| 4,398,129 | 8/1983 | Logan | 315/241 R |
| 4,550,275 | 10/1985 | O'Loughlin | 315/240 |
| 4,627,063 | 12/1986 | Hosokawa | 372/38 |
| 4,748,382 | 5/1988 | Walker | 315/240 |
| 4,748,551 | 5/1988 | Dickey | 363/126 |
| 4,780,287 | 10/1988 | Zeff et al. | 422/186.3 |
| 4,829,530 | 5/1989 | Sato et al. | 372/38 |
| 4,941,957 | 7/1990 | Zeff et al. | 204/157.3 |
| 5,045,759 | 9/1991 | Ye et al. | 315/171 |

*Primary Examiner*—Eugene R. Laroche
*Assistant Examiner*—Michael B. Shingleton
*Attorney, Agent, or Firm*—Cooley Godward Castro Huddleson & Tatum

[57] ABSTRACT

A flash lamp power supply system, comprising (a) a simmer power supply circuit, comprising (i) a DC simmer power supply, (ii) means for connecting a flash lamp in series with the DC power supply, and (iii) a capacitor connected in parallel to the power supply and to the flash lamp connecting means, wherein the impedance and capacitance of the simmer power supply are selected so as to provide dV/dT for the simmer power supply circuit equal to or greater than the rate at which the lamp impedance changes during a flash cycle; and (b) a pulse power supply circuit, comprising (i) a DC pulse source voltage supply, (ii) a thyristor, and (iii) means for connecting the lamp in series with the DC pulse source voltage supply and the thyristor, wherein the pulse power supply circuit further comprises a capacitor connected in parallel with the pulse source voltage supply.

12 Claims, 2 Drawing Sheets

SWITCHING POWER SUPPLY FOR HIGH-VOLTAGE FLASH LAMPS

BACKGROUND OF THE INVENTION

1. Field of the Invention

The present invention is directed to the field of power supplies and is more specifically directed to a power supply suitable for use as a flash lamp simmer supply.

2. Background

Flash lamps, which are generally filled with xenon or krypton, produce intense pulses of light when subjected to an increase in voltage from below to above the voltage required to generate an arc through the lamp. The lamps are not operated in a continuous fashion, but, as indicated by their name, in a flashing mode by supplying pulsed voltage to the lamps.

Because of the intensity of light produced, such lamps are desirable for high intensity applications; however, such lamps have previously not been operated with high efficiency when used to produce ultraviolet light. Operation of a flash lamp with high output in the deep ultraviolet requires very high peak power and current levels, thus forcing the lamp to operate under conditions not required for normal visible light production.

For example, it is generally desirable to operate flash lamps in a so-called simmer mode, in which a small current is passed through the lamps on a continuous basis, with the simmer current and voltage being insufficient to produce the high-energy flash of light. When flash lamps are operated in the simmer mode, they typically have increased lamp life and improved efficiency of conversion of electrical energy to light energy. Operation in a simmer mode also eliminates the need to restart the lamp prior to each flash.

However, the high voltage and amperage required for efficient UV light production causes problems with existing simmer circuits. The major drawback to use of flash lamps in a simmer mode in both visible and UV light production is the relatively large amount of power consumed by the simmer power supply. The classic simmer supply is a high-voltage power supply connected to the lamp through a string of resistors referred to as "ballast" resistors. Such a power supply produces a relatively constant current through the lamp, because the relatively high resistance of the ballast resistors provides most of the resistance in the circuit despite variations in voltage across the lamp during discharge. The particular voltage used will depend on the operating characteristics of the lamp being used, but typically is in the range of several hundred to more than a thousand volts (e.g., typically about 1500 volts for a six-inch arc). The high open-circuit voltage from the simmer power supply has the additional advantage of reducing the energy required to start the lamp.

A major disadvantage in such a system is that the ballast resistors dissipate significant power. For example, if a lamp is to be simmered using a 1500-volt power supply at a current of 1 amp, and the lamp voltage drop at that current is 100 V, then the power dissipated by the resistors is 1400 W while the lamp energy dissipation is only 100 W. If a lamp were to be operated at a pulse input power of 4,000 W (average), then the simmer power would represent 37.5% of the total lamp power consumption.

An apparent technique for overcoming this difficulty would be to use a switching power supply to provide the 1 amp of simmer current as needed by the circuit.

Switching power supplies are well known and can be purchased through commercial electrical suppliers. If a switching power supply with an efficiency of 80% were used, then the total power consumed by the simmer current would be 125 W, or only 3.1% of the lamp pulse power. Such a system has not been amenable to prior design, however, since the lamp, when pulsed, has a dynamic impedance that changes its V/I characteristics on the millisecond time scale following a flash. The simmer current must be maintained at a constant nominal value despite this variation in lamp impedance. Typically, at a 2 amp simmer current, the initial voltage drop as measured with a resistive power supply is approximately 120 V, increasing to 200 V during operation before returning to the steady-state value. If the simmer current and power supply voltage are not properly matched, the lamp voltage drop can reach a peak at which the supply can no longer provide sufficient current. If this happens, the lamp will go out, and the advantages of using a simmer mode will be lost.

Prior simmer circuits used with relatively low-power flash lamps operating in the visible light range overcame this problem by including the previously mentioned ballast resistor, with the resulting loss in efficiency as discussed above. This was not a problem in operations such as flash photography, where energy consumption is not normally a relevant issue. However in UV applications involving chemical photolysis, such as are being contemplated by the present inventors, continuous flashing at high voltage is required, and the inefficiency of existing simmer circuits represents a major cost in the operation of the lamp.

Circuits have been designed for use in other applications where the current needs to remain constant in spite of variations in load resistance. For an example of such a circuit used for other applications, see U.S. Pat. No. 4,748,551. However, such circuits are not directly applicable to flash lamp power supplies, as they provide time-averaged (rather than instantaneous) constant current through the varying resistance and are designed for AC (rather than DC) operation. Accordingly, there remains a need for switching power supplies useful as an ultraviolet flash lamp supply.

SUMMARY OF THE INVENTION

Accordingly, it is an object of the present invention to provide an electronic circuit and apparatuses using the circuit that provide a switching power supply for flash lamps.

It is a further object of the present invention to increase efficiency of power supplies used with xenon lamps and other types of flash lamps.

These and other objects of the invention have been accomplished by providing a flash lamp power supply system, comprising (a) a simmer power supply circuit, comprising (i) a switching DC simmer power supply, (ii) means for connecting a flash lamp in series with the simmer power supply, and (iii) a capacitor connected in parallel to the power supply and to the flash lamp connecting means, wherein the impedance and capacitance of the simmer power supply circuit are selected so as to provide dV/dT for the simmer power supply circuit equal to or greater than the rate at which the lamp impedance changes during a flash cycle; and (b) a pulse power supply circuit, comprising (i) a DC pulse source voltage supply, (ii) a thyristor, and (iii) means for connecting the lamp in series with the DC pulse source voltage supply and the thyristor, wherein the pulse power supply circuit further comprises a capacitor connected in parallel with the pulse source voltage supply. In preferred embodiments, a bypass circuit is provided around the thyristor, the bypass comprising a resistor in parallel with the thyristor in a first bypass circuit and a resistor and capacitor in series with each other and in parallel with the thyristor and the first bypass circuit in a second bypass circuit. In one embodiment of the invention, a series pair (or more) of thyristors is used, with the thyristors being provided with both AC and DC divider circuits as described above, to divide the voltage from the pulsed power source equally between the two thyristors. Specific characteristics of the individual components used in the circuit are selected according to the characteristics of the lamp. In particular, the impedance and capacitance of the simmer supply are selected so as to provide dV/dT for the simmer power supply circuit equal to or greater than the rate at which the lamp impedance changes.

These and other objects of the invention will be better understood from the following written description when considered in connection with the accompanying drawings in which a preferred embodiment of the invention is illustrated by way of example.

DETAILED DESCRIPTION OF THE SPECIFIC EMBODIMENTS

Figure 1:
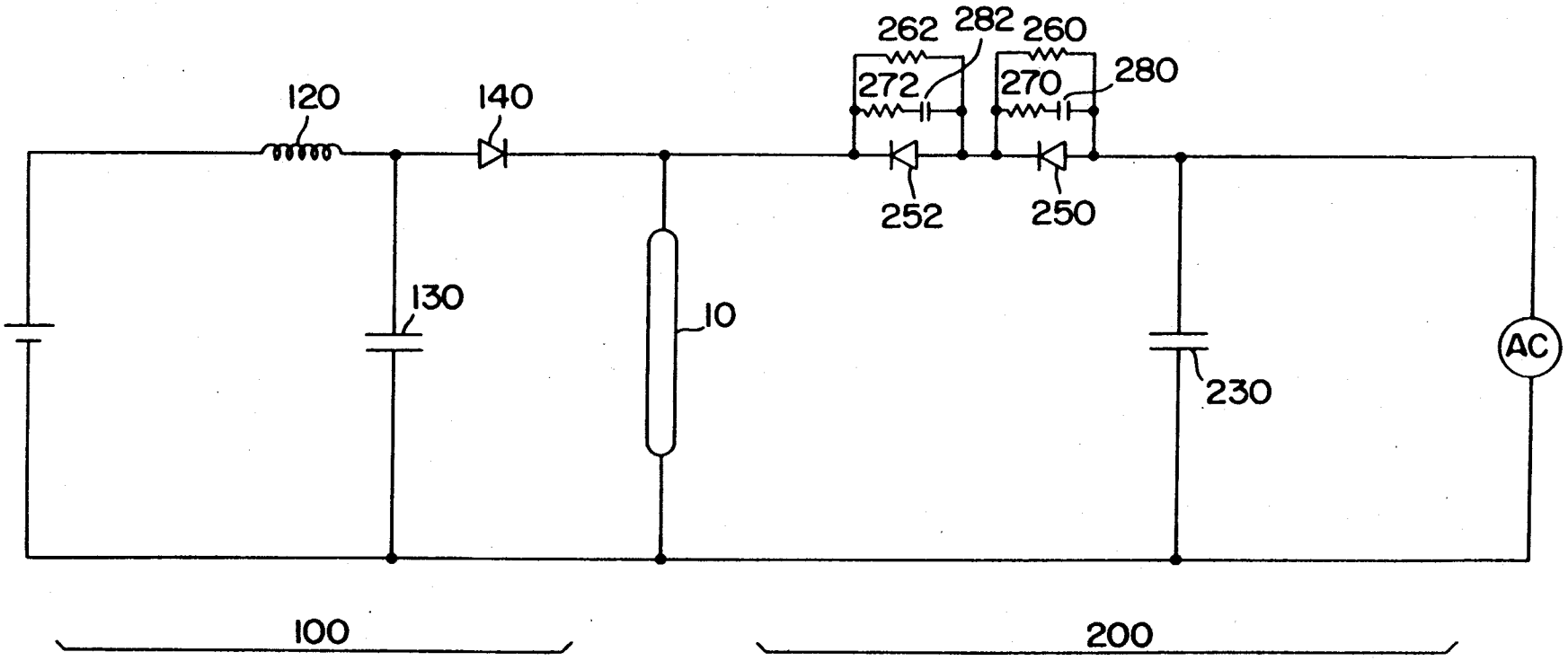
FIG. 1 is a circuit diagram showing one embodiment of a circuit of the present invention.

The present invention can be readily understood by considering a flash lamp connected in parallel to separate simmer current and voltage pulse power supplies. While it will be apparent to one of ordinary skill in the art that a single power supply can be utilized with appropriate circuitry to provide both voltage sources, the following description is of separate circuits for ease and clarity of description.

The simmer power supply circuit comprises a switching DC voltage source and a capacitor in series. The voltage source is selected to have an open circuit voltage that is at least two times, and preferably five time, the anticipated lamp simmer voltage. Output of the simmer power supply is in parallel across the capacitor, which is therefore referred to as the output capacitor. A high-voltage diode can be used in the connection between the power supply as described above and a flash lamp connected to the power supply. The diode helps to protect (when needed and desired) the simmer power supply from the higher voltage of the pulse discharge and isolates the capacitance of the supply from the pulse.

The capacitance of the output capacitor is selected to be sufficiently small so that, at the selected simmer current level, the change in voltage with respect to time (dV/dt) of the power supply is equal to or greater than the rate at which the lamp impedance changes. The value of the capacitance will therefore vary with the particular characteristics of the lamp or lamps used. The optimum value of the output capacitor for a particular lamp and pulse-forming configuration should be determined empirically. If desired, a variable capacitor can be provided so that the same simmer supply can be used with different flash lamps. The capacitance is selected to be sufficiently large so that a stable voltage supply is provided while being sufficiently small to provide the desired dV/dt value. The impedance present in the circuit can be the natural impedance of the circuit or can be supplied by a separate inductor, as described herein.

A second voltage supply connected to the flash lamp is typically used as the pulse source. A capacitor is connected across the output of the pulse source voltage supply. For any given lamp and pulse-forming network, the optimum value of the output capacitor will be determined empirically. First, the desired simmer current is established. The lamp is then started with a relatively large capacitor, and the system is pulsed. If too large an initial capacitor is used, the simmer will be extinguished. The capacitance will then be reduced until the simmer is maintained and the peak lamp voltage measured with an oscilloscope is below (usually by at least 10%) the supply open-circuit maximum.

The flash lamp is isolated from the pulse power source by a thyristor, typically a silicon-controlled rectifier (SCR), although other types of thyristors can be used. See the *SCR Manual,* Fifth (or any later) Edition, a publication of the Semiconductor Products Department of the General Electric Company, Syracuse, NY, for a discussion of SCRs and other thyristors. This specification uses the term thyristor to refer to all semiconductor switches whose bistable action depends on p-n-p-n regenerative feedback, in accordance with the standard industrial use of this term.

In preferred embodiments of the invention, bypass circuits are provided around the thyristor to facilitate starting the lamp, thereby reducing the requirements of open-circuit high voltage placed on the simmer supply. The DC bypass consists of a resistor in parallel with the thyristor. The AC bypass consists of a resistor and capacitor in series with each other and in parallel with the thyristor. The DC bypass acts as a shunt around the thyristor and applies high voltage to the lamp during the period in which the gas in the lamp is in its non-conducting state (i.e., while the gas is un-ionized). The AC bypass provides sufficient energy prior to initiation of a pulse to heat the lamp plasma to a point where the low-voltage simmer supply (which operates, for example, at about 600 V) can provide current to the lamp. This configuration allows a lower voltage simmer power supply than was previously available in the prior art.

In other embodiments of the invention at least one of the power supplies receives power from a single phase or polyphase AC mains or from a polyphase AC mains and transformer with a rectified output. Also, in other embodiments of the invention the simmer power supply has a smaller static output impedance than the lamp impedance under simmer conditions or has a smaller dynamic output impedance than the dynamic lamp impedance immediately following a flash.

In some embodiments of the invention, a series pair (or more) of thyristors is used instead of one thyristor. In such cases, bypass circuits must be provided around each thyristor in order to ensure that pulse power is equally divided between the thyristors. The bypass circuits function in this manner as both AC and DC divider circuits, in addition to providing the voltage and heating energy to the lamp. Multiple thyristors are not required if a single thyristor is available having a breakdown voltage higher than the highest voltage supplied to the circuit.

A pulse is generated in the pulse circuit by supplying a triggering pulse to the gate terminal of the thyristor at a repetition rate commensurate with the power level desired. The pulse is of sufficient width (e g., about 20 μs), amplitude (e.g., about 1 amp), and open-circuit voltage (e.g., about 40 volts) to prevent gate inversion and ensure reliable, long-life operation of the thyristor. Prior to initiation of the pulse discharge (via the triggering pulse) and for a sufficient time following the discharge (usually a few hundred microseconds), the pulse power supply is inhibited (turned off) so that the thyristors will have time to recover to their nonconducting state. This process is augmented by the reverse bias of the simmer voltage.

Turning now to the drawings, FIG. 1 is a circuit diagram showing an exemplary embodiment of the present invention. Two power supplies are shown, a simmer current power supply 100 and a pulse voltage power supply 200.

The simmer current power supply comprises a DC voltage source 110, an inductor 120, and a capacitor 130 connected in series. One output contact (for the lamp) is provided between inductor 120 and capacitor 130 and the other between capacitor 130 and the power supply. A diode 140 is provided to protect simmer power supply 100 from pulse voltage power supply 200, which supplies a higher voltage.

Electrical properties of the individual components are selected in accordance with the individual characteristics of the lamp used in the circuit. In an actual circuit prepared as shown in FIG. 1, the lamp consisted of two series lamps of 6 mm internal diameter, 15 cm total arc length. The lamps were filled to 700 Torr with xenon and had a total simmer voltage of approximately 130 V. Capacitor 130 had a capacitance of 23.5 μF, while voltage source 110 provided 600 V to the lamps (open circuit). Inductor 120 represents the natural impedance of the circuit, which was not measured. This natural impedance is determined by the internal characteristics and switching frequency of the power supply (200) and can has as a natural lower limit the stray inductance of the discrete components and wiring. In another embodiment of the invention, the simmer power supply circuit further comprises an inductor in series with the DC power supply and the capacitor.

Pulse voltage power supply 200 comprised voltage source 210 and capacitor 230, with the voltage to the lamp being provided across capacitor 230. The embodiment shown in FIG. 1 shows two thyristors, 250 and 252, in series. Both AC and DC bypass circuits are provided around the thyristors, which in this case also function as divider circuits. Resistors 260 and 262 respectively provide the two DC bypass circuits, and resistors 270 and 272 and capacitors 280 and 282, respectively, provide the AC bypass circuits. Each bypass circuit was provided with identical resistors and capacitors in order to equally divide current through and around the two thyristors, thereby protecting this aspect of the circuit.

In the physical embodiment referred to above, DC voltage supply 210 provided 2,100 V to the lamp in its non-conducting state. Resistors 260 and 262 were both 50,000 Ω resistors. The AC divider consisted of a 20 Ω resistor (270 and 272) in series with a 0.1 μF capacitor (280 and 282). Pulsing was controlled by simultaneously supplying a current pulse to the gate terminals of both thyristors, and the thyristors were reset by briefly inhibiting the power supply voltage.

When operated at 60 Joules per pulse (4,000 W) with a current pulse width (full width, at half max) of approximately 13 μs and pulse rates up to 67 pulses per second, the total power consumed by the simmer circuit was 390 watts, or 12% of the lamp pulse power (this includes an 80% power supply efficiency factor).

Figure 2:
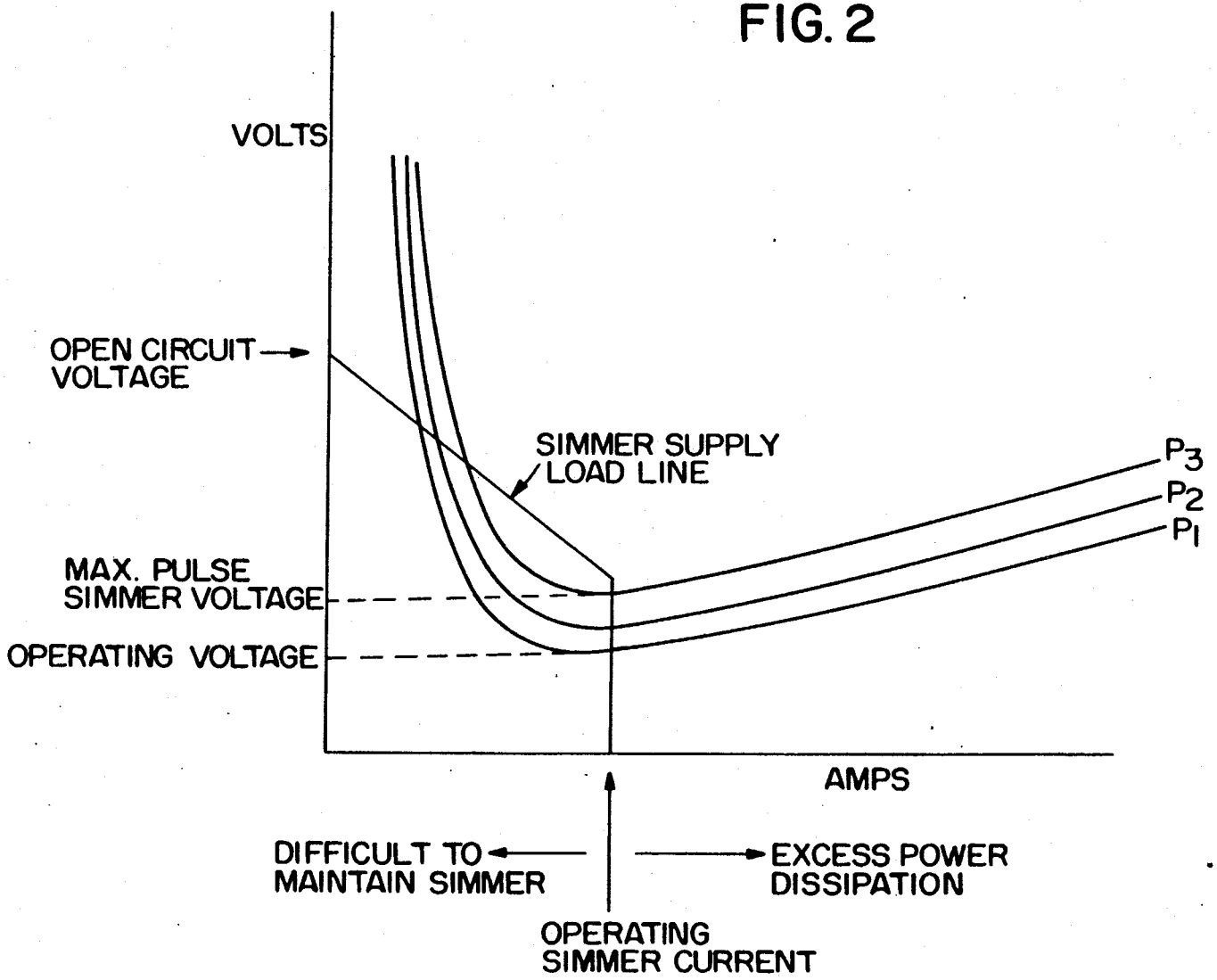
FIG. 2 is a graph of potential versus current for a series of different pressures in a theoretical flash lamp (Paschen curves).

Operating characteristics for other lamps can be determined empirically or approximated by calculation using the guidance provided above. Specific values of individual circuit elements can be approximated from Paschen's Law, which describes the relationship between voltage, gas pressure, and arc discharge length in a gas discharge lamp. For a fixed physical configuration, such as in a flash lamp, in which the gas type, gas pressure, arc length and electrode material are defined, the mathematical relationship of voltage to current contains two voltage parameters so that the voltage exhibits a minimum when plotted against the current. An example of a theoretical V/I plot is shown in FIG. 2. Although such curves can be estimated mathematically, they are best determined empirically for a particular lamp. To the right of the minimum, the voltage increases approximately with the square root of the current and has a positive slope. To the left of the minimum, the voltage increases rapidly and has a negative slope.

The point at which a power supply of the invention will operate at discharge is determined by plotting the power supply characteristics (load line) of the simmer power supply on the same graph as the Paschen curve and noting the intercepts. The system will settle to the lowest voltage (highest current) intercept. As can be seen in FIG. 2, Paschen's Law defines a series of V/I curves for different pressures ($P_1<P_2<P_3$ in FIG. 2). Since the temperature (and thus the pressure) of the gas in the lamp changes during operation as discharges occur, this change in pressure must be taken into consideration in selecting circuit parameters.

For example, when the lamp is pulsed, the gas and plasma undergo changes which are related to the total energy content and peak power of the pulse. This can be modeled by complex theoretical calculations, but generally the higher the peak power, the more extreme the changes. During the pulse, the plasma is heated so that its impedance drops from tens of ohms to about one ohm. This means that the voltage drop at the simmer current would be only a few volts. The plasma recombines rapidly but is at a higher pressure than prior to discharge. This forces the impedance upward rapidly and can cause the simmer voltage to exceed the quiescent level by a factor of two or more. If the simmer current is kept perfectly constant during this time (a few milliseconds), the discharge will return to its prepulse condition. If, however, the current drops, the operating condition will shift toward the left on the Paschen curve and may move past the load line intersection, causing the discharge to extinguish. Note that the operating point is effectively shifted to the left even at the same current by the fact that the Paschen curve for the transient higher pressure condition is itself shifted to the right. This requires that the initial operating position be selected sufficiently to the right of the minimum so that the operation is still to the right of the load line intercept when higher transient pressures are encountered.

All publications and patent applications mentioned in this specification are herein incorporated by reference to the same extent as if each individual publication or patent application was specifically and individually indicated to be incorporated by reference.

The invention now being fully described, it will be apparent to one of ordinary skill in the art that many changes and modifications can be made thereto without departing from the spirit or scope of the appended claims.

What is claimed is:

1. A flash lamp power supply system, comprising:

(a) a simmer power supply circuit, comprising (i) a DC simmer power supply, (ii) means for connecting a flash lamp in series with said DC power supply, and (iii) a capacitor connected in parallel to said power supply and to said flash lamp connecting means, wherein the impedance and capacitance of the simmer power supply are selected so as to provide dV/dT for the simmer power supply circuit equal to or greater than the rate at which the lamp impedance changes during a flash cycle; and (b) a pulse power supply circuit, comprising (i) a DC pulse source voltage supply, (ii) at least one thyristor, and (iii) means for connecting said lamp in series with said DC pulse source voltage supply and said thyristors, wherein said pulse power supply circuit further comprises a capacitor connected in parallel with said pulse source voltage supply.

2. The power supply of claim 1, wherein a dual bypass circuit is provided in parallel with said thyristor, said dual bypass circuit comprising a resistor in parallel with said thyristor in a first bypass circuit and a resistor and capacitor in series with each other and in parallel with said thyristor in a second bypass circuit.

3. The power supply of claim 2, wherein said thyristor is a component of a circuit element comprising a plurality of thyristors in series, wherein each of said thyristors is provided with said dual bypass circuit containing identical resistors and capacitors, whereby voltage from said pulse voltage supply is divided equally between said thyristor.

4. The power supply of claim 1, wherein said simmer power supply circuit further comprising an inductor in series with said DC power supply and said capacitor.

5. The power supply of claim 1, wherein said simmer power supply circuit further comprises a diode in said circuit which isolates said circuit from current pulses generated by said pulse power supply circuit.

6. The power supply of claim 1, wherein power is provided to said circuits from a DC mains.

7. The power supply of claim 1, wherein at least one of said power supplies receives power from a single phase or polyphase AC mains.

8. The power supply of claim 1, wherein at least one of said power supplies receives power from a polyphase AC mains and transformer with a rectified output.

9. The power supply of claim 1, wherein said simmer power supply has a smaller static output impedance than the lamp impedance under simmer conditions.

10. The power supply of claim 1, wherein said simmer power supply has a smaller dynamic output impedance than the dynamic lamp impedance immediately following a flash.

11. The power supply of claim 1, wherein resistance in said simmer power supply is limited to inherent resistance of claimed components of said simmer power supply circuit and connecting conductors.

12. The power supply of claim 1, wherein said simmer power supply operates at a current of 1 amp of higher.

* * * * *